US008184078B2

(12) United States Patent
Bu et al.

(10) Patent No.: US 8,184,078 B2
(45) Date of Patent: May 22, 2012

(54) LIQUID CRYSTAL DISPLAY AND SOURCE DRIVING CIRCUIT HAVING A GAMMA AND COMMON VOLTAGE GENERATOR THEREOF

(75) Inventors: Lin-Kai Bu, Sinshih Township, Tainan County (TW); Hui-Min Wang, Sinshih Township, Tainan County (TW)

(73) Assignee: Himax Media Solutions, Inc., Tainan County (TW)

( * ) Notice: Subject to any disclaimer, the term of this patent is extended or adjusted under 35 U.S.C. 154(b) by 774 days.

(21) Appl. No.: 12/327,376

(22) Filed: Dec. 3, 2008

(65) Prior Publication Data

US 2010/0134470 A1 Jun. 3, 2010

(51) Int. Cl.
*G09G 3/36* (2006.01)

(52) U.S. Cl. ..... 345/89; 345/100

(58) Field of Classification Search ..... 345/211–213, 345/87–89, 98–100
See application file for complete search history.

(56) References Cited

U.S. PATENT DOCUMENTS

2006/0022929 A1* 2/2006 Hashimoto et al. ..... 345/96
2006/0097969 A1* 5/2006 Tsai et al. ..... 345/88
2006/0279498 A1* 12/2006 Kaneda et al. ..... 345/89
2007/0120805 A1* 5/2007 Yi ..... 345/100
2008/0291190 A1* 11/2008 Kim et al. ..... 345/211

* cited by examiner

*Primary Examiner* — Chanh Nguyen
*Assistant Examiner* — Long D Pham
(74) *Attorney, Agent, or Firm* — Thomas, Kayden, Horstemeyer & Risley, LLP

(57) ABSTRACT

A source driving circuit includes a gamma voltage generator, a common voltage generator and a driver. The gamma voltage generator receives gamma data from a timing controller through reduced swing differential signaling (RSDS) transmission interface to generate corresponding gamma voltages. The common voltage generator receives common voltage data from the timing controller to generate a corresponding common voltage. The driver receives image data from the timing controller through the RSDS transmission interface, the gamma voltages from the gamma voltage generator and the common voltage from the common voltage generator for modifying the image data using the gamma voltages and the common voltage and transmitting the modified image data to a panel of the liquid crystal display.

8 Claims, 6 Drawing Sheets

LIQUID CRYSTAL DISPLAY AND SOURCE DRIVING CIRCUIT HAVING A GAMMA AND COMMON VOLTAGE GENERATOR THEREOF

BACKGROUND

1. Field of Invention

The present invention relates to a driving circuit. More particularly, the present invention relates to a source driving circuit of a liquid crystal display.

2. Description of Related Art

In a conventional liquid crystal display, there usually includes a driver system where a source driving circuit can be designed therein, and a timing controller system where a timing controller, a gamma circuit and a common voltage circuit can be designed therein. The gamma circuit and common voltage circuit cooperate with the timing controller and transmit the gamma voltage and common voltage, respectively, to the source driving circuit.

However, since the gamma circuit and common voltage circuit both are usually designed in the timing controller system, there must be extra costs for them. Thus, there is a need to incorporate the gamma circuit and common voltage circuit or the functions thereof into the source driving circuit in order to save the costs.

SUMMARY

In accordance with one embodiment of the present invention, a source driving circuit of a liquid crystal display is provided. The source driving circuit includes a gamma voltage generator, a common voltage generator and a driver. The gamma voltage generator receives gamma data from a timing controller through reduced swing differential signaling (RSDS) transmission interface to generate corresponding gamma voltages. The common voltage generator receives common voltage data from the timing controller to generate a corresponding common voltage. The driver receives image data from the timing controller through the RSDS transmission interface, the gamma voltages from the gamma voltage generator and the common voltage from the common voltage generator for modifying the image data using the gamma voltages and the common voltage and transmitting the modified image data to a panel of the liquid crystal display.

In accordance with another embodiment of the present invention, a liquid crystal display is provided. The liquid crystal display includes a timing controller, a display panel and a source driving circuit. The timing controller transmits image data, gamma data and common voltage data using reduced swing differential signaling (RSDS) transmission interface. The source driving circuit includes a gamma voltage generator and a driver, in which the gamma voltage generator receives the gamma data and the common voltage data from the timing controller to generate a corresponding common voltage and corresponding gamma voltages, and the driver receives the image data from the timing controller, the common voltage and the gamma voltages from the gamma voltage generator for modifying the image data in response to the common voltage and the gamma voltages and delivers the modified image data to the display panel.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference to the accompanying drawings as follows.

DESCRIPTION OF THE PREFERRED EMBODIMENTS

In the following detailed description, the embodiments of the present invention have been shown and described. As will be realized, the invention is capable of modification in various respects, all without departing from the invention. Accordingly, the drawings and description are to be regarded as illustrative in nature, and not restrictive.

Figure 1:
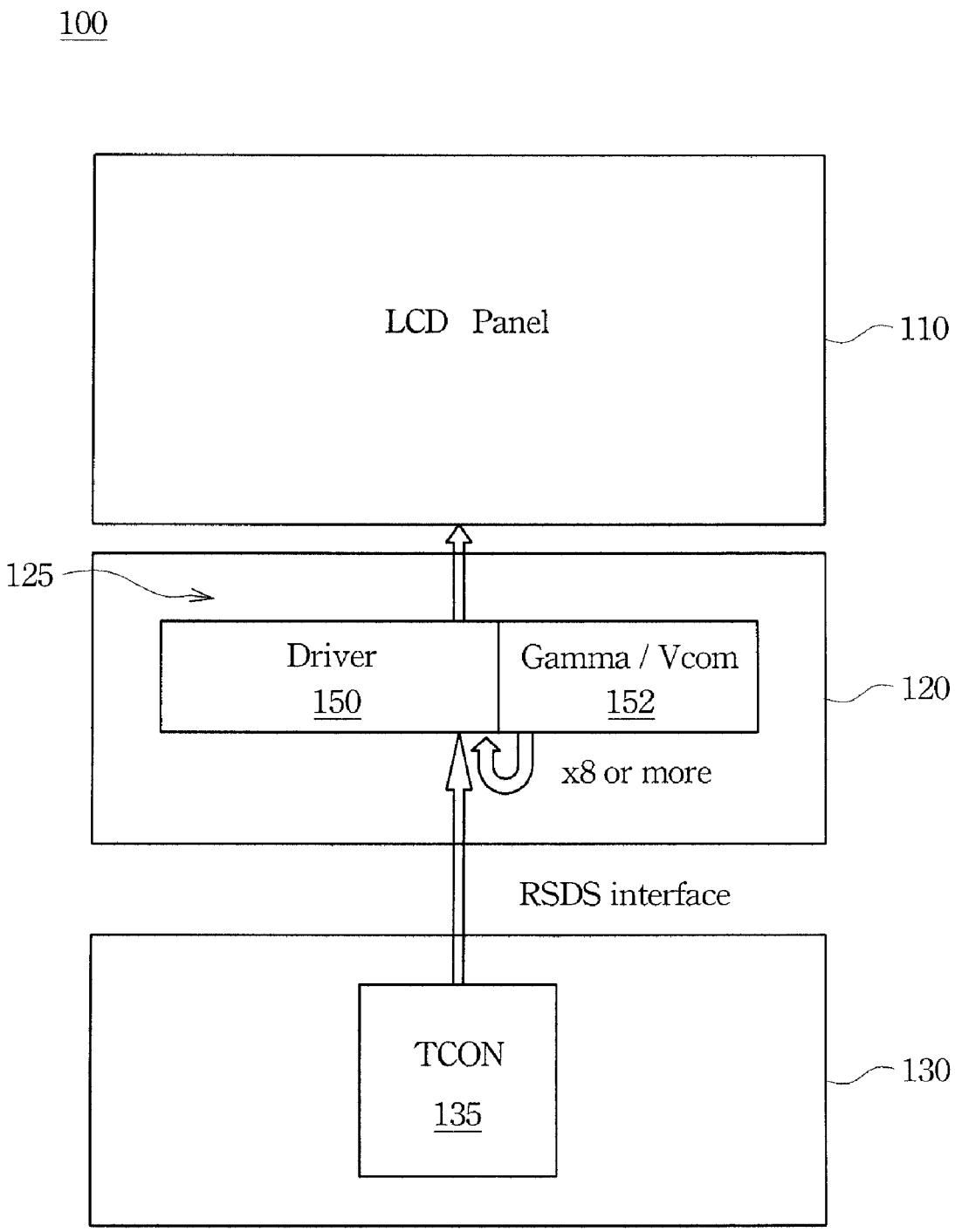
FIG. 1 illustrates a general block diagram of a liquid crystal display according to one embodiment of the present invention.

FIG. 1 illustrates a general block diagram of a liquid crystal display according to one embodiment of the present invention. The liquid crystal display (LCD) 100 includes an LCD panel 110, an LCD driving system 120 and a timing controlling system 130, in which the LCD driving system 120 includes a source driving circuit 125 and the timing controlling system 130 includes a timing controller (TCON) 135. The timing controller 135 transmits image data, gamma data, common voltage data, timing data, etc., using reduced swing differential signaling (RSDS) transmission interface, to the source driving circuit 125 such that the source driving circuit 125 can accordingly drive the LCD panel 110 to display corresponding image.

The source driving circuit 125 further includes a gamma voltage generator, a common voltage generator and a driver 150, in which the gamma voltage generator and the common voltage generator can be individually designed in the source driving circuit 125 or, for example, integrated into a gamma/common voltage generator 152 in the present embodiment. Nevertheless, the functions of the individual gamma voltage generator and the common voltage generator may be similar to those of the gamma/common voltage generator 152.

In the present embodiment, the gamma/common voltage generator 152 receives the gamma data from the timing controller 135 through the RSDS transmission interface to generate corresponding gamma voltages and also receives common voltage data from the timing controller 135 to generate a corresponding common voltage. The driver 150 receives image data from the timing controller 135 through the RSDS transmission interface, the gamma voltages and the common voltage from the gamma/common voltage generator 152, for modifying the image data using the gamma voltages and the common voltage and transmitting the modified image data to the LCD panel 110.

The gamma/common voltage generator 152 can be incorporated into the source driving circuit 125 because it includes operational amplifiers (OP) and digital-to-analog converters (DAC) like the driver 150 and functions in a similar manner to the driver 150 as well. Thus, if the timing controller 135 transmits the gamma data through the RSDS transmission interface, the gamma data can be processed only by the source driving circuit 125.

Figure 2:
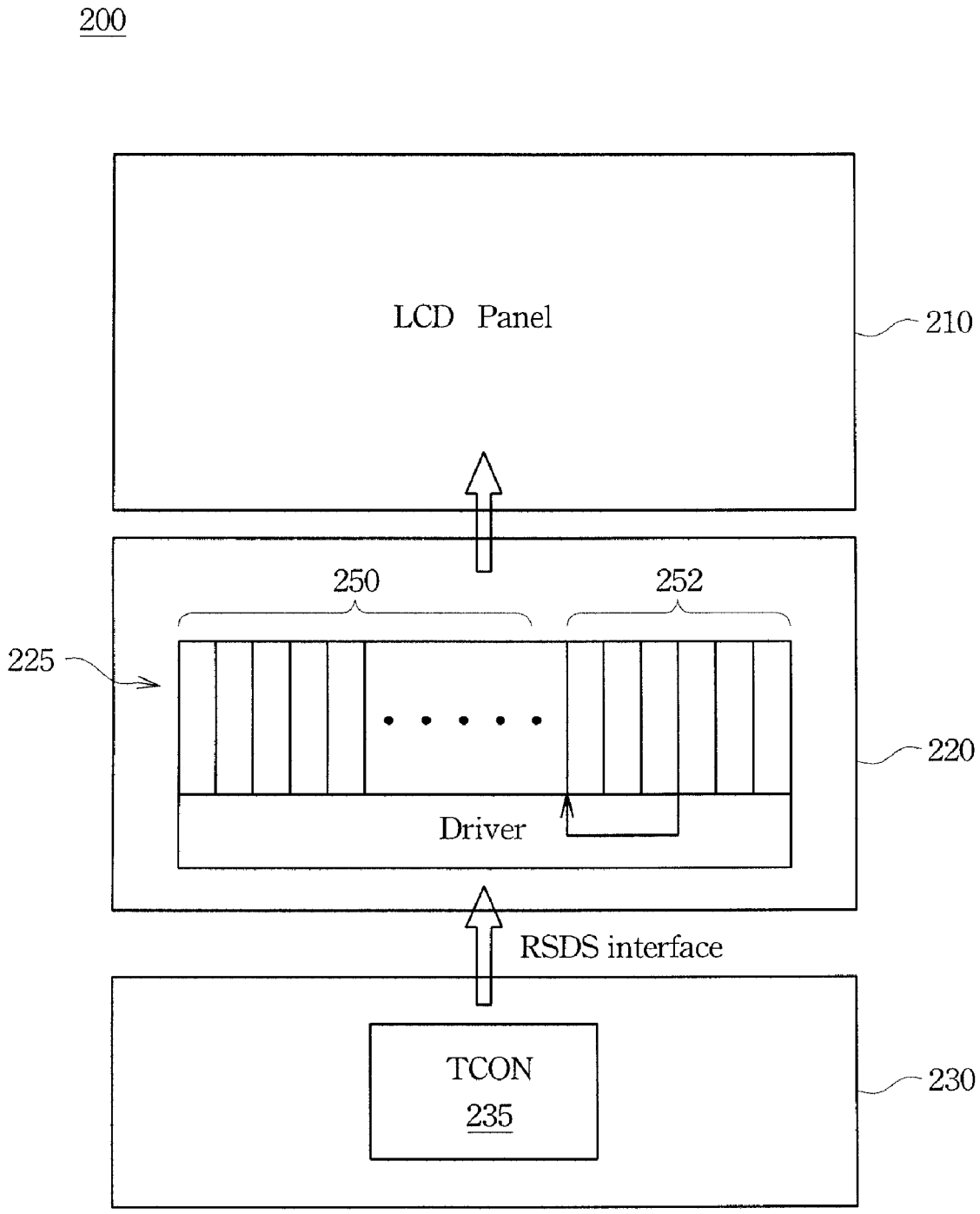
FIG. 2 illustrates a general block diagram of a liquid crystal display according to another embodiment of the present invention.

FIG. 2 illustrates a general block diagram of a liquid crystal display according to another embodiment of the present invention. Compared to FIG. 1, the source driving circuit 225 is implemented by a driver (similar to the driver 150 in FIG. 1) which has a plurality of processing channels 250 and a plurality of dummy channels 252, and each of the processing channels 250 and the dummy channels 252 includes an OP and a DAC. Notably, the processing channels 250 are used for the functions of the driver 150 in FIG. 1 while the dummy channels 252 are used for the functions of the gamma/common voltage generator 152 in FIG. 1. In other words, if the dummy channels of the driver are preset, the gamma/common voltage generator 152 in FIG. 1 can be incorporated, by using the preset dummy channels, into the driver to save the costs.

In the following embodiments, the gamma/common voltage generator which is incorporated by using the preset dummy channels are discussed, and only a few dummy channels, each of which includes a DAC and a buffer unit, are illustrated in order to simplify the discussion and should be regarded as illustrative in nature, and not restrictive.

Figure 3:
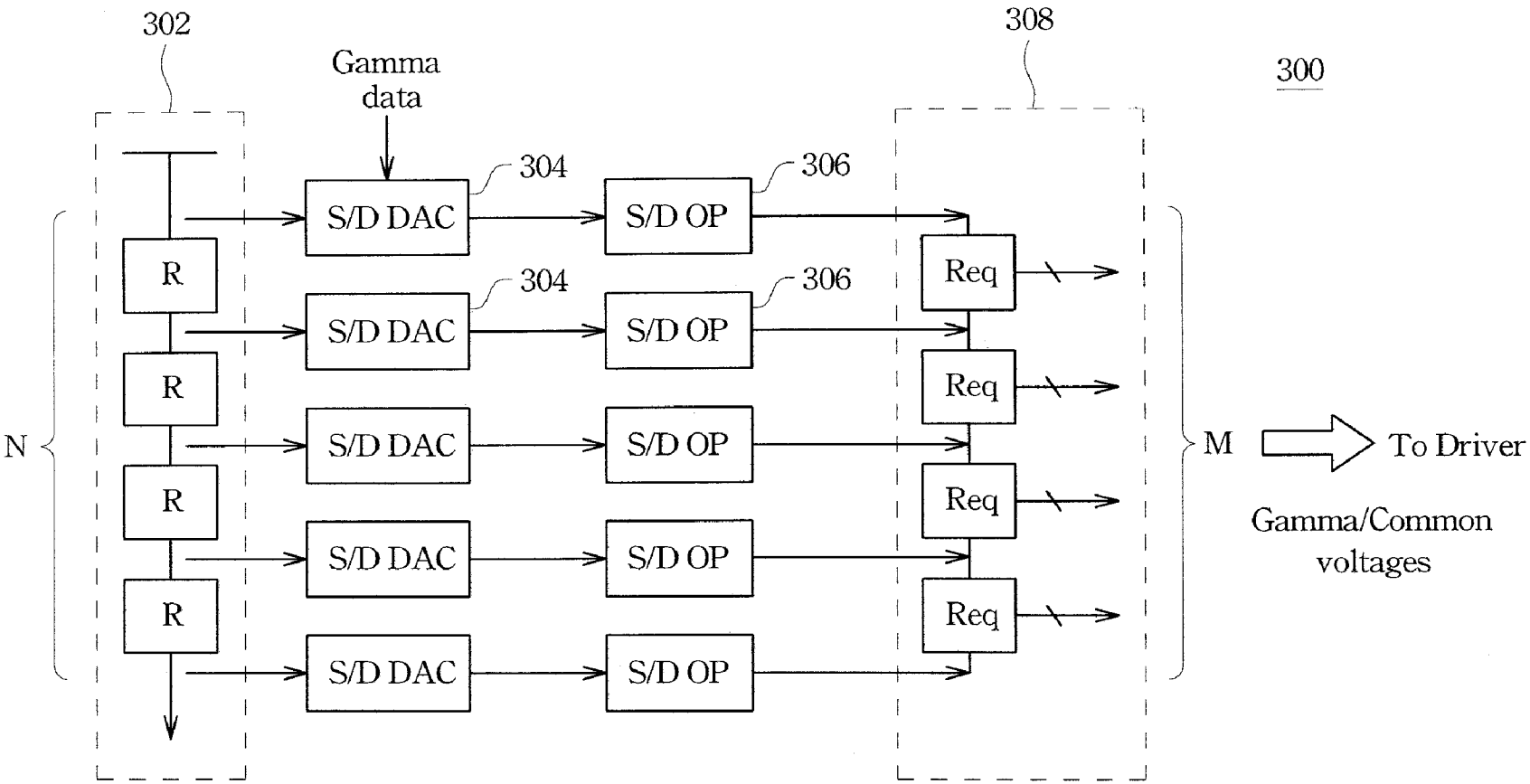
FIG. 3 illustrates a block diagram of the gamma/common voltage generator according to a first embodiment of the present invention.

FIG. 3 illustrates a block diagram of the gamma/common voltage generator according to a first embodiment of the present invention. The gamma/common voltage generator 300 includes a reference voltage generator 302, a plurality of DACs 304, a plurality of buffer units 306 and a voltage-dividing element 308, in which the DACs 304 and the buffer units 306 can be dummy DACs and dummy buffer units pre-configured in the source driving circuit.

The reference voltage generator 302 can be an R-string circuit and generate N reference voltages having different voltage levels in accordance with a voltage-divided resistance ratio. The DACs 304 receives the reference voltages and the gamma data, transmitted from the timing controller, and correspondingly generates N (N is an integer) gamma voltages according to the gamma data. In addition, one of the DACs 304 can receive one of reference voltages and the common voltage data, transmitted from the timing controller, and correspondingly generate the common voltage (VCOM) according to the common voltage data.

The buffer units 306 can be implemented by operational amplifiers (OP) and stabilize the common voltage and the gamma voltages from the DACs 304. The voltage-dividing element 308 can be an R-string circuit consisted of serially connected resistors Req, each of which is further consisted of several resistors. The voltage-dividing element 308 transforms the N gamma voltages generated by the DACs 304 into M (M is an integer) gamma voltages, where M can be larger than N; that is, the voltage-dividing element 308 is used for division of voltages to generate M gamma voltages having different voltage levels in accordance with a voltage-divided resistance ratio. Afterwards, the generated gamma voltages and common voltage are transmitted to the driver.

Figure 4:
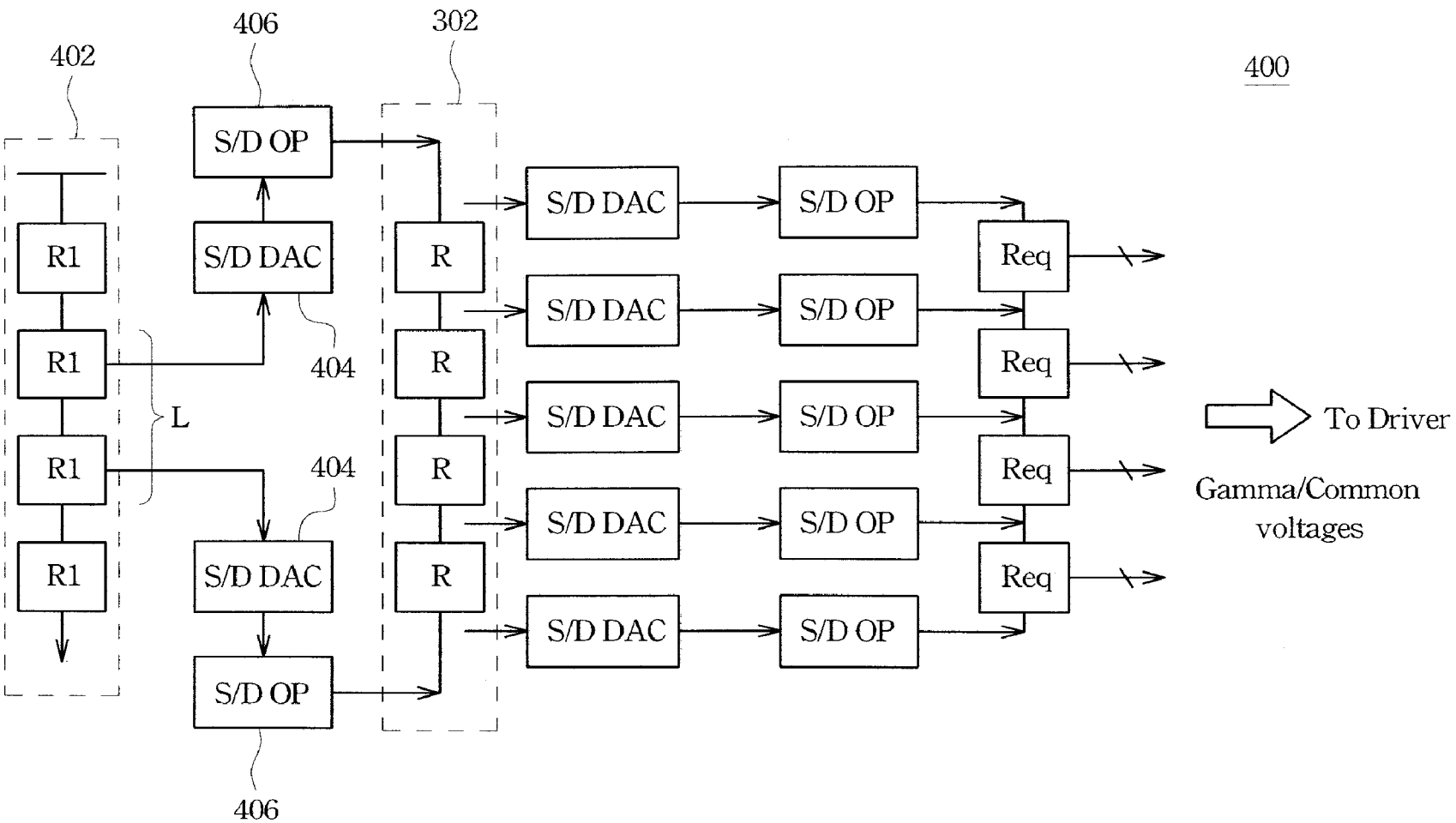
FIG. 4 illustrates a block diagram of the gamma/common voltage generator according to a second embodiment of the present invention.

FIG. 4 illustrates a block diagram of the gamma/common voltage generator according to a second embodiment of the present invention. Compared to FIG. 3, the gamma/common voltage generator 400 further includes a preset reference voltage generator 402, a plurality of DACs 404 and a plurality of buffer units 406. The preset reference voltage generator 402 can be an R-string circuit and generate L (L is an integer and can be smaller than N) reference voltages having different voltage levels. The DACs 404 receives the reference voltages and the gamma data, transmitted from the timing controller, and correspondingly generates L gamma voltages according to the gamma data. The buffer units 406 can be implemented by operational amplifiers and stabilize the gamma voltages from the DACs 404. Afterwards, the gamma voltages are transmitted through the buffer units 406 to the reference voltage generator 302 to be transformed into the corresponding reference voltages. Notably, the DACs 404 and the buffer units 406 can be dummy DACs and dummy buffer units, respectively, pre-configured in the source driving circuit as well. As a result, the preset reference voltage generator 402 can generate the roughly tuned reference voltages and then the reference voltage generator 302 can generate the fine tuned reference voltages.

Figure 5:
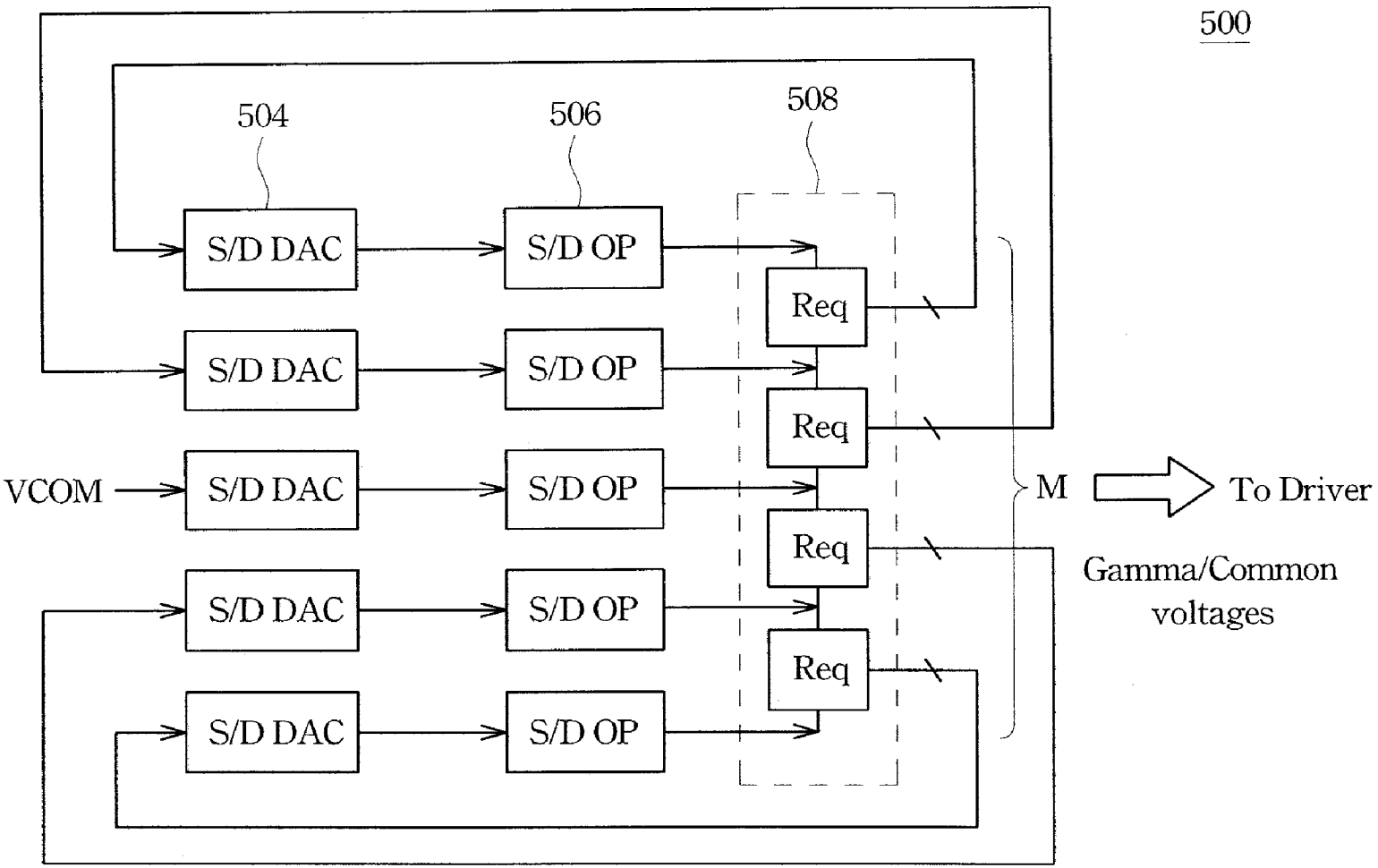
FIG. 5 illustrates a block diagram of the gamma/common voltage generator according to a third embodiment of the present invention.

FIG. 5 illustrates a block diagram of the gamma/common voltage generator according to a third embodiment of the present invention. Compared to FIG. 3, the M gamma voltages, in addition to be transmitted to the driver, are further fed back to and selected by a number of the DACs 504 to be the reference voltages. As a result, the reference voltage generator can be thus saved and the costs can be accordingly reduced.

Figure 6:
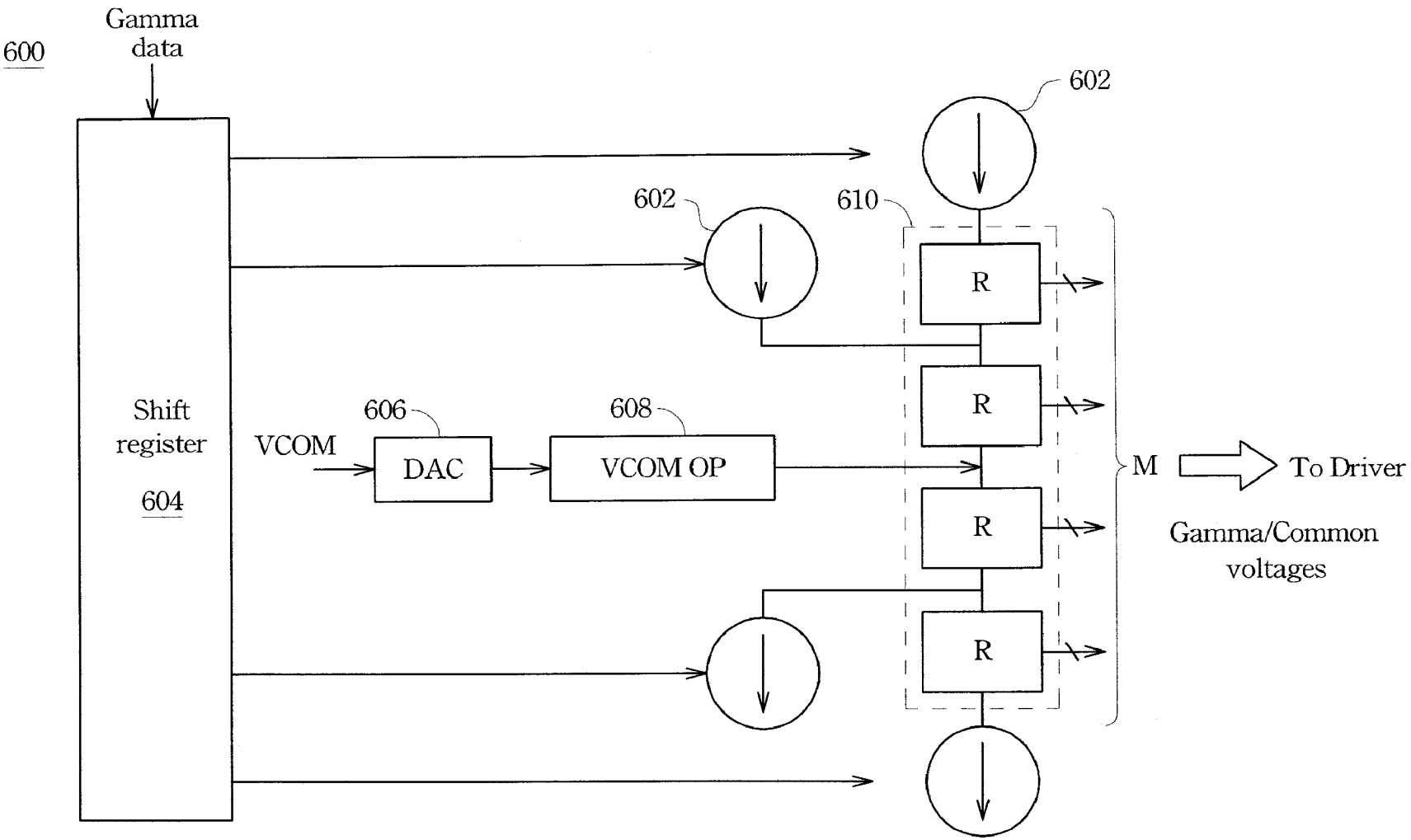
FIG. 6 illustrates a block diagram of the gamma/common voltage generator according to a fourth embodiment of the present invention.

FIG. 6 illustrates a block diagram of the gamma/common voltage generator according to a fourth embodiment of the present invention. The gamma/common voltage generator 600 includes a plurality of current sources 602, a shift register 604, a DAC 606, a VCOM buffer unit 608 and a voltage-dividing element 610, in which the current sources 602 can be digital adjustable high-impedance current sources. The shift register 604 selectively controls the current sources 602 according to the gamma data transmitted from the timing controller. The current sources 602 are correspondingly coupled to voltage-divided nodes of the voltage-dividing element 610 such that the M gamma voltages are selectively generated when the current sources 602 selectively flow through the voltage-dividing element 610. In other words, the shift register 604 can control the current sources 602 according to the gamma data such that different currents flow through the voltage-dividing element 610 and different gamma voltages can be thus generated. The DAC 606 generates a common voltage according to the VCOM data. The VCOM buffer unit 608, which may be implemented by an operational amplifier, stabilizes the common voltage from the DAC 606 and transmits the common voltage to the driver. As a result, the DACs and the buffer units for the gamma voltages can be saved and the costs can be accordingly reduced.

For the foregoing embodiments, the source driving circuit can be provided to save the extra costs in the timing controller system. In addition, the source driving circuit can thus generate dynamic gamma voltages due to receiving the dynamic gamma data transmitted from the timing controller system. In other words, the gamma data can be continually transmitted from the timing controller system to the source driving circuit, and the gamma curve performed by the source driving circuit can be thus updated continually.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A source driving circuit of a liquid crystal display, comprising:

a gamma voltage generator for receiving gamma data from a timing controller through reduced swing differential signaling (RSDS) transmission interface to generate corresponding gamma voltages, wherein the gamma voltage generator further comprises a voltage-dividing element for division of voltages to generate M gamma voltages having different voltage levels, wherein M is an integer;

a common voltage generator for receiving common voltage data from the timing controller to generate a corresponding common voltage, wherein the common voltage generator further comprises a first digital-to-analog converting unit for receiving a first reference voltage and generating the common voltage according to the common voltage data, and the gamma voltage generator further comprises a plurality of second digital-to-analog converting units for receiving second reference voltages having different voltage levels and for generating N gamma voltages according to the gamma data to be transformed into the M gamma voltages by the voltage-dividing element, wherein the M gamma voltages are further fed back to and selected by the second digital-to-analog converting units to be the second reference voltages; and a driver for receiving image data from the timing controller through the RSDS transmission interface, the gamma voltages from the gamma voltage generator and the common voltage from the common voltage generator for modifying the image data using the gamma voltages and the common voltage and transmitting the modified image data to a panel of the liquid crystal display.

2. The source driving circuit as claimed in claim 1, wherein the first digital-to-analog converting unit and the second digital-to-analog converting units are dummy digital-to-analog converting units pre-configured in the source driving circuit.

3. The source driving circuit as claimed in claim 1, the common voltage generator further comprises a first buffer unit for stabilizing the common voltage from the first digital-to-analog converting unit, and the gamma voltage generator further comprises a plurality of second buffer units for stabilizing the N gamma voltages from the second digital-to-analog converting units.

4. The source driving circuit as claimed in claim 3, wherein the first buffer unit and the second buffer units are dummy buffer units pre-configured in the source driving circuit.

5. A liquid crystal display, comprising:

a display panel;

a timing controller for transmitting image data, gamma data and common voltage data using reduced swing differential signaling (RSDS) transmission interface; and a source driving circuit, comprising:

a gamma voltage generator for receiving the gamma data and the common voltage data from the timing controller to generate a corresponding common voltage and corresponding gamma voltages, wherein the gamma voltage generator further has a plurality of channels comprising a first channel for generating the common voltage according to the common voltage data and second channels for generating N gamma voltages according to the gamma data to be transformed into the M gamma voltages by the voltage-dividing resistor unit, wherein the first channel further comprises a first digital-to-analog converting unit for receiving a first reference voltage and generating the common voltage according to the common voltage data, and the second channels further comprises a plurality of second digital-to-analog converting units for receiving second reference voltages having different voltage levels and for generating the N gamma voltages according to the gamma data, wherein the M gamma voltages are further fed back to and selected by the second digital-to-analog converting units to be the second reference voltages; and a driver for receiving the image data from the timing controller, the common voltage and the gamma voltages from the gamma voltage generator for modifying the image data in response to the common voltage and the gamma voltages and delivering the modified image data to the display panel.

6. The liquid crystal display as claimed in claim 5, wherein the gamma voltage generator further comprises:

a voltage-dividing resistor unit for division of voltages to generate M gamma voltages having different voltage levels, wherein M is an integer.

7. The liquid crystal display as claimed in claim 5, wherein the first channel further comprises a first buffer unit for stabilizing the common voltage from the first digital-to-analog converting unit, and the second channels further comprises a plurality of second buffer units for stabilizing the N gamma voltages from the second digital-to-analog converting units.

8. The liquid crystal display as claimed in claim 5, wherein the channels are dummy channels pre-configured in the source driving circuit.

* * * * *